US006588741B2

(12) United States Patent
Dobrindt

(10) Patent No.: US 6,588,741 B2
(45) Date of Patent: Jul. 8, 2003

(54) STACKING DEVICE OF A PRINTING PRESS

(75) Inventor: Dirk Dobrindt, Klausdorf/Schwentine (DE)

(73) Assignee: NexPress Solutions LLC, Rochester, NY (US)

( * ) Notice: Subject to any disclaimer, the term of this patent is extended or adjusted under 35 U.S.C. 154(b) by 0 days.

(21) Appl. No.: 10/151,641

(22) Filed: May 20, 2002

(65) Prior Publication Data

US 2002/0180141 A1 Dec. 5, 2002

(30) Foreign Application Priority Data

Jun. 1, 2001 (DE) ..... 101 26 893

(51) Int. Cl.[7] ..... B65H 29/46

(52) U.S. Cl. ..... 271/84; 271/85; 271/306; 271/220

(58) Field of Search ..... 271/84, 85, 306, 271/220

(56) References Cited

U.S. PATENT DOCUMENTS

| | | | | | |
|---|---|---|---|---|---|
| 1,974,241 | A | * | 9/1934 | Hewitt | 271/84 |
| 2,276,269 | A | * | 3/1942 | Dudley | 101/276 |
| 2,831,684 | A | * | 4/1958 | Cundall | 271/85 |
| 4,770,405 | A | | 9/1988 | Fukushima et al. | 471/176 |
| 5,375,834 | A | * | 12/1994 | Rathert | 271/310 |
| 6,419,223 | B1 | * | 7/2002 | Sting et al. | 271/268 |
| 6,488,278 | B1 | * | 12/2002 | Hansch | 271/268 |

FOREIGN PATENT DOCUMENTS

| | | | | |
|---|---|---|---|---|
| DE | 42 35 961 A1 | | 4/1994 | B41F/21/08 |
| DE | 100 47 395 A1 | | 5/2001 | B65H/29/04 |
| JP | 57184055 A | * | 11/1982 | B65H/29/40 |
| JP | 59203052 A | * | 11/1984 | B65H/29/40 |

* cited by examiner

*Primary Examiner*—Donald P. Walsh
*Assistant Examiner*—Mat Kohner
(74) *Attorney, Agent, or Firm*—Lawrence P. Kessler

(57) ABSTRACT

The invention relates to a stacking device as well as to a method for depositing sheets on a stack. The task of the invention is to provide a stacking device that deposits sheets on a stacking unit quickly, cost effectively and reliably. The invention solves this task with a method for depositing sheets and a stacking device that contains two gripping devices for alternately gripping and depositing sheets.

9 Claims, 6 Drawing Sheets

STACKING DEVICE OF A PRINTING PRESS

FIELD OF THE INVENTION

The invention relates in general to a method and apparatus for stacking sheets in a printing press. More specifically, after the run through the printing module of a printing press, the printed sheets are stacked in a stacking unit of the printing press where various solutions are used to pick up the sheet from the sheet path and to deposit it on the stacking unit.

BACKGROUND OF THE INVENTION

One prior art mechanism for stacking sheets involves the gripping of the sheet in a transport path with a mechanical gripper, which has two gripper plates that partially grasp the sheet and carry it from the path to a stacking unit. The gripper then deposits the sheet on the stacking unit. However, the speed of this stacking solution is limited, since only one sheet per run is grasped by the gripper and carried to the stacking unit. The speed characteristic is an important criterion for modern high speed, high productivity printing machines.

SUMMARY OF THE INVENTION

This invention deposits sheets on a stacking unit quickly, cost effectively and reliably. The invention is directed to a method for depositing sheets, and a stacking device that contains two gripping devices, for alternately picking up and depositing sheets relative to a stack. A first gripping device picks up a sheet advantageously within reach of the sheet transport, while a second gripping device simultaneously holds the sheet stack, whereby the sheets to be deposited are at a lower level to prevent the sheet stack from moving during this process. The arrangement of the sheet on this sheet stack is in registered alignment, or stacking may also be offset lengthwise to the sheet transport path. Conveyor rollers are used for this purpose, which slow down the run of the transported sheet at a specific point in time and thus determine the stacking of various sheets in an offset manner in the lengthwise direction. The sheets may then be removed by the operator in stacks from the printing press at the rate of approximately one offset stack per printing job.

The invention and its advantages will be better understood from the ensuing detailed description of preferred embodiments, reference being made to the accompanying drawings in which like reference characters denote like parts.

BRIEF DESCRIPTION OF THE DRAWINGS

In the detailed description of the preferred embodiment of the invention presented below, reference is made to the accompanying drawings, in which.

DETAILED DESCRIPTION OF THE INVENTION

Figure 1:
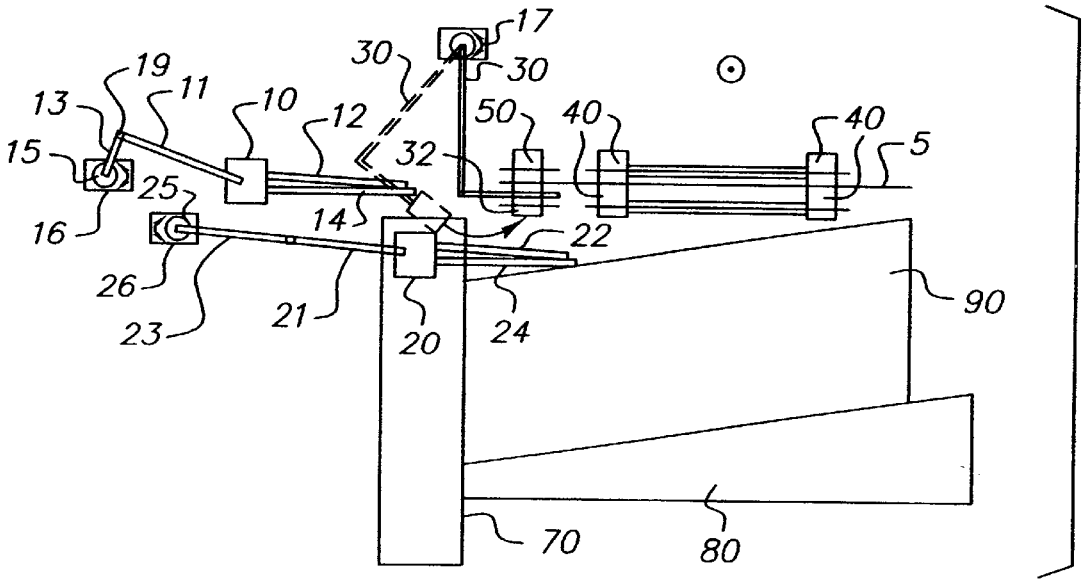
FIG. 1 is a schematic front view of a stacking device of a printing press, whereby a gripping device holds down the sheet stack and a second gripping device waits for a sheet from the sheet path.

Referring now to the accompanying drawings, FIG. 1 shows a schematic front view of a stacking device of a printing press. Following the printing process, sheets 5 are delivered in the direction of the observer (out of the plane of the drawing) to the sheet-stacking unit. The conveyance of the sheets 5 is essentially performed by the conveyor rollers 40 and the side conveyor rollers 50, which turn in the same direction as the delivery direction of the sheet 5. A complete transfer of the sheet 5 between the conveyor rollers 40 and the side conveyor rollers takes place at this point. There is a gap between the side conveyor rollers 50 that is smaller than the size of the smallest sheet format used with the printing press. A reliable transport of various sheet formats is ensured in this manner.

Grippers of a first gripper device 10 are located at approximately the height of the side conveyor rollers 50. The first gripper device 10 is arranged approximately 50–60 mm above and beside a sheet stack 90. A second gripping device 20 is located on the side under the first gripping device 10, whereby in the present situation, grippers of the second gripping device 20 are positioned on the sheet stack 90 and retain and hold down sheets 5 already deposited on the sheet stack 90. The gripper devices 10, 20 essentially contain at least one gripper respectively, and in this example, the gripper devices 10, 20 each contain five individual grippers, with an upper gripper plate 12, 22 and a lower gripper plate 14, 24, respectively. Further, there is provided a device for moving the gripping devices 10, 20 between at least two positions and a control device for controlling the opening/closing of the grippers and the movement between at least of the two positions, whereby the alternating positions of the gripping devices 10, 20 at the sheet stack 90 and close to the sheet path 8 of the printing press are defined by two positions, as described above and which can be seen in FIG. 1. The stacking device or stacker contains a tray 80 that is inclined and perpendicular to a wall of the stacking unit or bordering on the stacker wall, which provides a stacker ledge 70 for the sheets 5.

There is a stepping motor 16 for moving the first gripper device 10 and a stepping motor 26 for moving the second gripper device 20. Gripping device 10 is driven by a crank mechanism comprising a stepping motor 16, a crank 13, and a connecting rod 11. Gripping device 20 is driven by a crank mechanism comprising a stepping motor 26, a crank 23, and a connecting rod 21. The stepping motor 16 is connected to the first gripping device 10 via a crank 13 and a connecting rod 11. The stepping motor 26 is connected to the second gripping device 20 via a crank 23 and a connecting rod 21. Detailed description of crank mechanisms is given in FIG. 3, 4 and 5. Driving the stepping motor 16 and the stepping motor 26 the gripping device 10 and the gripping device 20 is moved, respectively. The guiding plate 30 is driven by a stepping motor 17. Guiding plate 30 is connected to stepping motor 17 and is moved around the axis of the stepping motor 17. As described FIG. 1 shows two positions of the guiding plate 30, one position shown with continuous lines and the other position shown with dashed lines.

Thus there is a sheet stack 90 that lies on the tray 80, which is inclined in the direction of the stacker ledge 70. The sheet path 8 is further bordered by at least one side guide 30, which is located next to the sheet path and which ensures reliable delivery of the sheet 5. The side guide 30 is indicated with solid lines in a position next to the sheet path and with dotted lines in a second position, in which the side guide is swiveled outwards. The side guide 30 contains another conveyor roller 32, which is positioned from below on the sheets 5 in the present state. In this first operating state, according to FIG. 1, the first gripping device 10 is located at approximately the height of the sheet path close to its end and the second gripping device 20 is located below the first gripping device 10 with the sheet stack 90. The lower gripper plates 24 of the gripper of the second gripping device 20 touch the sheet stack 90 from above and exert a force on it. For this reason, the sheets 5 of the sheet stack 90 maintain their position and are protected from slipping.

In FIG. 1, a sheet 5 is delivered by the conveyor rollers 40 and the side transport rollers 50 in the direction of the arrow. Next, the gripper plates 12, 14 of the first gripper device 10 open and allow the sheet 5 to be delivered between the gripper plates 12, 14. As soon as the sheet 5 is located at a specific section between the gripping plates 12, 14, the gripping plates 12, 14 of the gripping device 10 close and grasp the sheet 5. The gripping device 10 is then moved from its first position in FIG. 1 to a second position in which the second gripping device 20 in FIG. 1 is located. At the same time, the second gripping device 20 is moved, controlled by the control device of the gripping devices 10, 20, from the second position to the first position near the sheet stack 90. The first gripping device 10 approaches the sheet stack 90 and the stacking wall with the stacker ledge 70. The lower gripping plate 14 of the gripping device 10 moves past the stacker ledge 70 and touches the stacker ledge 70 in such a way that the sheet 5 is released from the grip of the lower and upper gripping plates 12 and 14 and is ejected. As a result, the sheet 5 is deposited on the sheet stack 90, whereby the edge of the sheet borders the stacker ledge 70, due to the ejection of the sheet 4 at the stacker ledge 70 and the inclined tray 80.

When the gripping devices 10, 20 have reached their end position, they have switched their positions; the first gripping device 10 is located at the second position in which the second gripping device 20 is located in FIG. 1 and vice versa. The first gripping device 10 now holds down the sheet stack 90 and the second gripping device 10 opens its gripping plates 22, 24 to pick up another sheet. The directions of movement of the two gripping devices 10, 20 are both horizontal and vertical and are controlled by the control device. It is obvious from the description to date that the gripping devices 10, 20 have switched their positions and their respective functions at the positions; the gripping devices 10, 20 are used alternately to hold down the sheet stack 90 and to grasp and carry sheets 5 to the sheet stack 90 of the tray 80. In their holding-down function, the lower gripping plates 14, 24, press the sheets 5 down on the sheet stack 90, as can be seen in FIG. 1.

Figure 2:
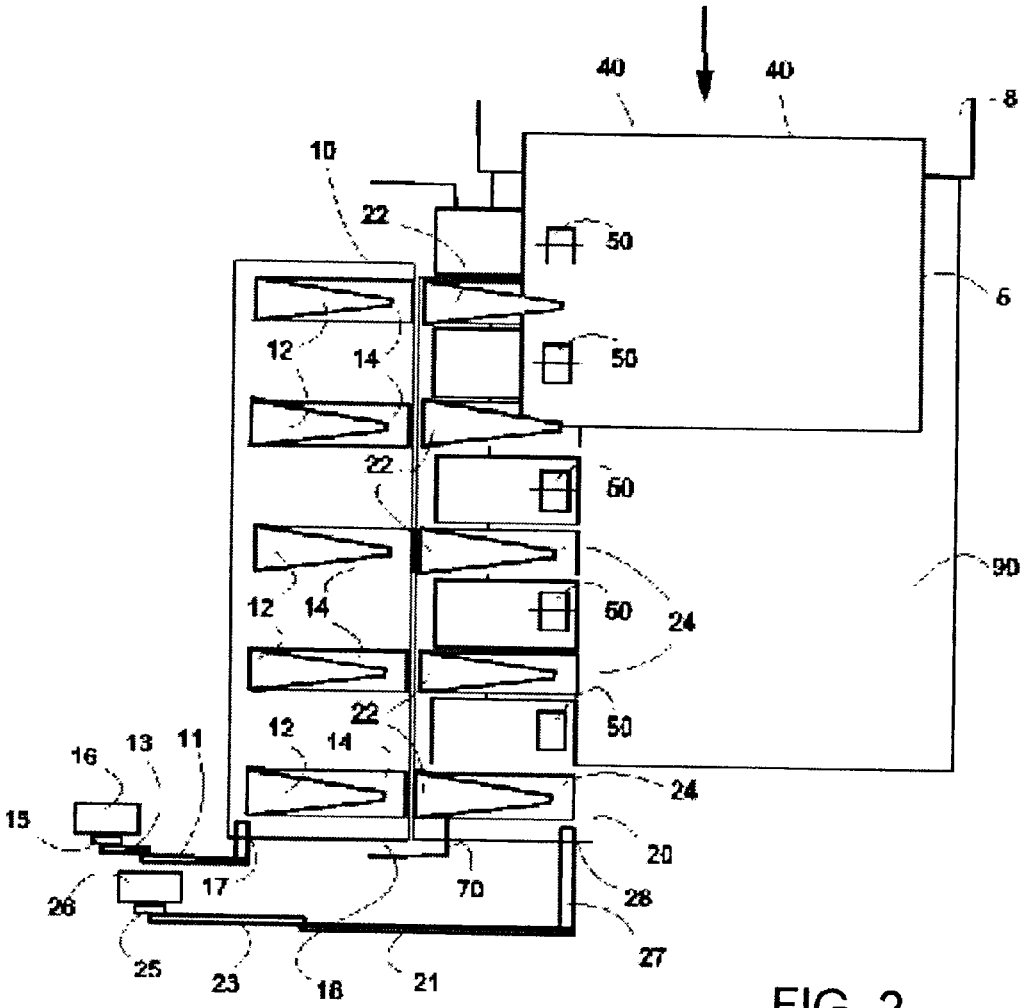
FIG. 2 is a schematic top view of a stacking device according to FIG. 1.

FIG. 2 illustrates a schematic top view of the stacking device according to FIG. 1. It can be seen that the side conveyors 50 are arranged approximately between the grippers of a second gripping device 20 at the second position. Furthermore, the side conveyor rollers 50 are arranged above the second gripping device 20, as can be seen in FIG. 1. In this illustration according to FIG. 2, the first gripping device 10 is located to the left next to the second gripping device 20; indeed, the first gripping device 10 is located above and laterally offset to the second gripping device 20. The upper gripping plates 12, 22 of the gripper taper horizontally in the direction of the sheet 5 and are shown coated on their insides that are gripping the sheets 5, so that the sheet 5 is not damaged by the gripping or transportation by the gripping devices 10, 20. The lower gripping plates 14, 24, have a rectangular shape. If further developed, the stacking device can be configured with an offset of the sheet position. This means that the sheets 5 are arranged with the stacks offset lengthwise, i.e., in the sheet running direction or "in track". This leads to a stack of sheets 5 that can be removed by the operator of the printing press in individual stacks, corresponding to a single printing job by the printing press. The offset of sheets 5 is achieved, in which the sheets 5 on their way over the sheet path are slowed down at various positions by the side conveyor rollers 50. Accordingly, the sheets 5 are transported more or less far in the direction of the direction arrow and reach various positions of length.

Figure 3:
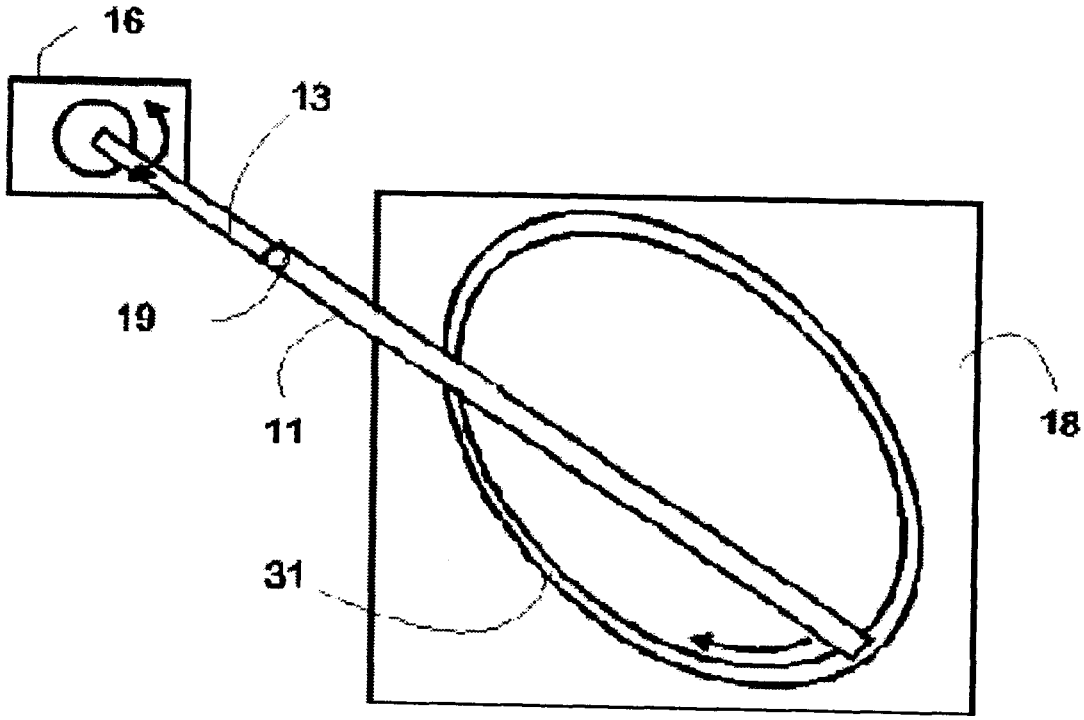
FIG. 3 shows a schematic view of a crank mechanism for the stacking device of this invention.

FIG. 3 shows a schematic view of the crank mechanism comprising stepping motor 16 connected to crank 13, which is connected to connecting rod 11 via a link 19. FIG. 3 makes clear the way the gripping device 10 is moved. In FIG. 3 crank mechanism is shown in a position at which crank 13 and connecting rod 11 are aligned and have their maximum length seen in the direction to plate 18. At one end connecting rod 11 comprises a pin 17 reaching through an opening 31 in the plate 18. As shown, opening 31 has a round form and the pin 17 is moved in the opening 31. At the other side of the plate 18 in FIG. 3 the pin 17 is connected to the gripping device 10. By driving the stepping motor 16, the crank mechanism is moved, with the crank mechanism moving the gripping device 10 as described above. In FIG. 3 crank mechanism comprising stepping motor 16, crank 13, connecting rod 11 and plate 18 is shown exemplary. A crank mechanism comprising stepping motor 26, crank 23, connecting rod 21, and plate 28 respectively is driven in the same way.

Figure 4:
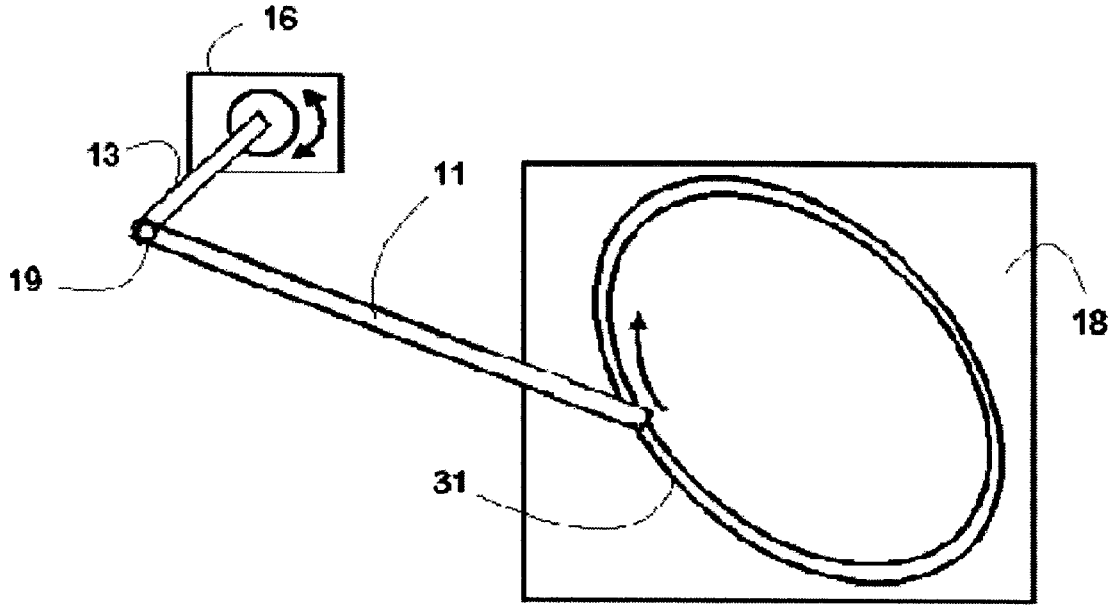
FIG. 4 shows a schematic view of the crank mechanism of FIG. 3 being in a further position.

FIG. 4 shows another position of the crank mechanism with the stepping motor 16 continued to move and the crank 13 and the connecting rod 11 being in different alignments. Stepping motor 16 has moved the crank 13 and the connecting rod 11 and consequently moved pin 17 at the end of the connecting rod 11 in the opening 31 and moved the gripping device 10 connected to the pin 17. The gripping device 10 relating to the position of the crank mechanism shown in FIG. 4 has another position comparing to FIG. 3 and is moved away from the sheet stack 90, as shown in FIG. 2.

Figure 5:
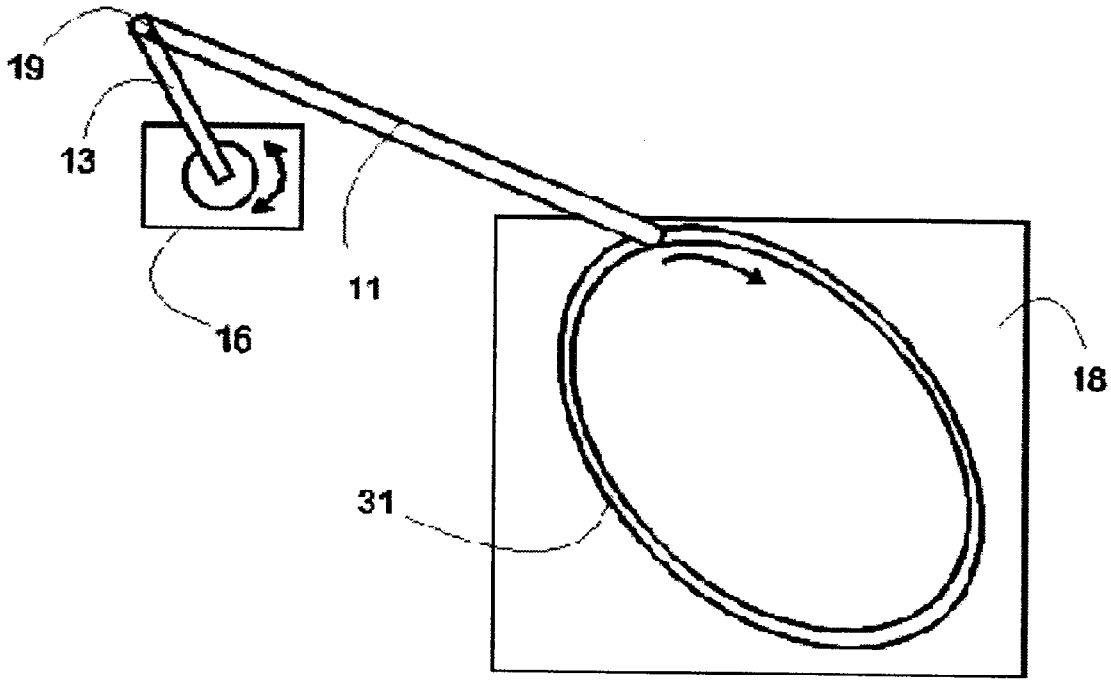
FIG. 5 shows a schematic view of the crank mechanism of FIG. 3 being in a still further position.

FIG. 5 shows another position of the crank mechanism with the stepping motor 16 continued to move and the crank 13 and the connecting rod 11 being in different alignments with the crank mechanism and the pin 17 being in a nearly extreme position and moving back to the position shown in FIG. 1 as indicated by the arrow. Pin 17 is moving further through opening 31 and reaches the position of FIG. 1 next.

Figure 6:
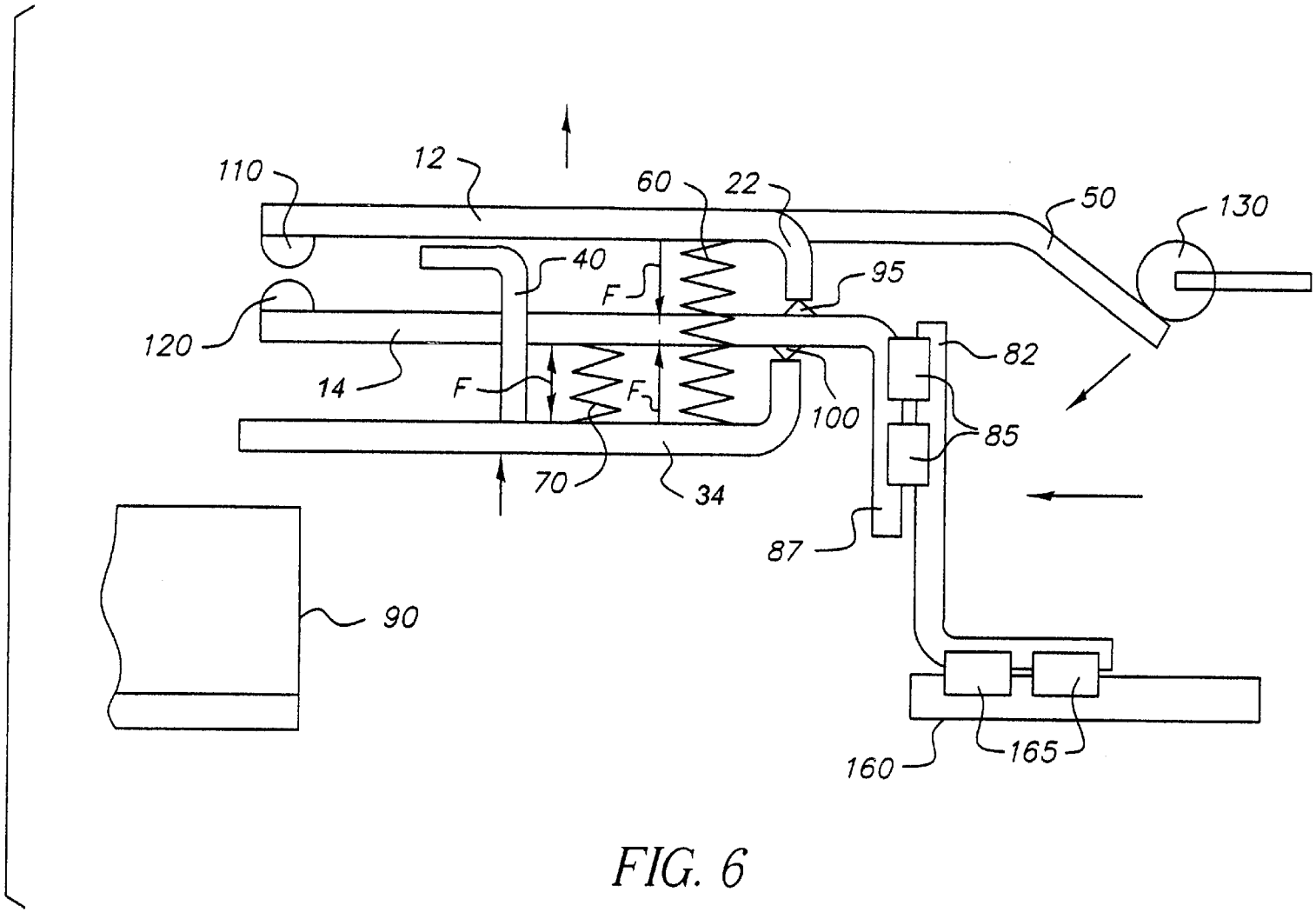
FIG. 6 shows a schematic side view of a gripping device utilized with this invention.

FIG. 6 illustrates a schematic side view of the gripping device 10, 20 in more detail driven by said stepping motor 16, 26 and crank mechanism. The upper gripping plate 12 and the lower gripping plate 14 include a clamping mouth 110 and a clamping mouth 120 (coated tabs) respectively for gripping a sheet between them. Upper gripping plate 12 is connected via a tension spring 60 to an arm 34 that initiates opening the clamping mouth 110 and the clamping mouth 120 by an arm 40 reaching from said arm 34 to the upper gripping plate 12. Upper gripping plate 12 has a lever 50, which touches a stop 130 in a position when the gripping device 10, 20 is moved in a direction towards the right side of FIG. 6. Movement in a horizontal direction is achieved by a slider 165 sliding on a guiding device 160, movement in a vertical direction is achieved by a slider 85 sliding on a guiding device 82, as shown in FIG. 6. Slider 85 is fixed to an arm 87 bent from said lower gripping plate 14. Sliding in vertical direction and in horizontal direction causes the gripping device 10, 20 to slide in vertical and in horizontal direction respectively. Upper gripping plate 12 and lower gripping plate 14 are connected by a tension spring 60. At one end upper gripping plate 12 is connected to a pivot 95 that is mounted at said lower gripping plate 14. The arm 34 is connected to a pivot 100 that is mounted at the rear side of the lower gripping plate 14. Lower gripping plate 14 is connected to arm 34 by a pressure spring 70. When lever 50 is moved towards stop 130 lever 50 presses against stop 130 causing upper gripping plate 12 to open clamping mouth 110. This is the open position for receiving a sheet between clamping mouth 110 and clamping mouth 120.

Next, with slider 85 moving along the guiding device 82 and slider 165 moving along guiding device 160, arm 34 is moved towards sheet stock 90 and is pressed against sheet stock 90. Thereby arm 40 presses against upper gripping plate 12 and moves upper gripping plate 12 so that clamping mouth 110 moves away from clamping mouth 120. Because of this the sheet between the clamping mouth 110 of the upper gripping plate 12 and the clamping mouth 120 of the lower gripping plate 14 let loose and falls onto the sheet stock 90. After the arm 34 leaving paper staple 90, force of the pressure spring 70 causes to close clamping mouth 110 and clamping mouth 120 by pressing arm 34 away from lower gripping plate 14 and consequently arm 40 releases force from upper gripping plate 12. Then the first gripping device 10 is moved away from the paper staple 90 and in the direction to stop 130 to take over a further sheet while the second gripping device 20 is moved towards the sheet stock 90. First gripping device 10 and second gripping device 20 take alternating positions as already described.

The invention has been described in detail with particular reference to certain preferred embodiments thereof, but it will be understood that variations and modifications can be effected within the spirit and scope of the invention.

What is claimed is:

1. Stacking device of a printing press, characterized in that the stacking device contains two gripping devices (10,20) for alternately grasping and depositing sheets (5), and a device for alternately moving said gripping devices (10, 20) between a first position, in which one of said gripping devices (10, 20) is positioned on a sheet stack and holds it down, and a second position, in which one of said gripping devices (10, 20) is located near the sheet path (8) to pick up a sheet (5).

2. Stacking device of a printing press according to claim 1, characterized in that said gripping devices (10, 20), respectively, contain rows of grippers consisting of individual grippers.

3. Stacking device of a printing press according to claim 2, characterized in that said grippers of the gripping devices (10, 20) have coated tabs.

4. Stacking device of a printing press according to claim 1, characterized by an arrangement of the sheet (5) on the sheet stack (90) offset lengthwise by controlled conveyor rollers (40, 50).

5. Stacking device of a printing press according to claim 1, characterized by a delivery tray (80) inclined diagonally to the sheet path (8).

6. Stacking device of a printing press according to claim 1, characterized in that said gripping devices 10, 20 are arranged between the two outermost conveyor rollers.

7. Stacking device of a printing press according to claim 1, characterized by a swiveling side guide (30).

8. Method for depositing sheets (5) on a delivery tray (80) of a printing press, characterized by gripping of a first sheet (5) by a first gripping device (10) at a first position and depositing of a second sheet (5) on a delivery tray (80) by a second gripping device (20), movement of the first gripping device (10) with the first sheet (5) in the direction of the second position with the delivery tray (80) and movement of a second gripping device (20) in the direction of the first position, depositing of the first sheet (5) on the delivery tray (80) by the first gripping device (10) and the gripping of a third sheet (5) by the second gripping device (20), and movement of the second gripping device (20) with the third sheet (5) in the direction of the second position and movement of the first gripping device (10) in the direction of the first position.

9. Method for depositing sheets (5) on a delivery tray (80) of a printing press according to claim 8, characterized by the running of the gripper along the stacker ledge (70), opening of the gripper as a reaction of the gripper hitting the sheet stack (80) and ejection of the sheet (5) from the gripper at the stacker ledge (70) by removal of the gripper from the sheet stack (80).

* * * * *